United States Patent [19]

Coleman et al.

[11] 3,936,837

[45] Feb. 3, 1976

[54] CORRUGATED HORN FED OFFSET PARABOLOIDAL REFLECTOR

[75] Inventors: H. Paris Coleman, Alexandria, Va.; Russell M. Brown, Bethesda; Billy D. Wright, Oxon Hill, both of Md.

[73] Assignee: The United States of America as represented by the Secretary of the Navy, Washington, D.C.

[22] Filed: Feb. 25, 1975

[21] Appl. No.: 552,907

[52] U.S. Cl. ..... 343/781; 343/786; 343/840

[51] Int. Cl.[2] ..... H01Q 15/16

[58] Field of Search ..... 343/781, 837, 840, 786

[56] References Cited

UNITED STATES PATENTS

| | | | |
|---|---|---|---|
| 3,055,004 | 9/1962 | Cutler | 343/781 |
| 3,274,603 | 9/1966 | Kay | 343/786 |
| 3,510,873 | 5/1970 | Trevisan | 343/786 |
| 3,733,609 | 7/1971 | Bartlett | 343/782 |

*Primary Examiner*—Eli Lieberman

*Attorney, Agent, or Firm*—R. S. Sciascia; A. L. Branning; N. V. Brown

[57] ABSTRACT

A high frequency antenna achieves low signal-levels in far-out sidelobe and backlobe antenna pattern regions through utilization of a corrugated feed-horn acting as a non-axial source for a cooperating parabolic reflector.

5 Claims, 3 Drawing Figures

CORRUGATED HORN FED OFFSET PARABOLOIDAL REFLECTOR

BACKGROUND OF THE INVENTION

The present invention relates to high frequency antenna systems and more particularly to microwave and millimeter wave antennas.

Interference to microwave and millimeter-wave signals is often caused by higher-than-desired signal levels outside the main antenna-beam region, particularly in what are generally termed the backlobe and far-out sidelobe regions of the antenna pattern. An antenna which could minimize the signal-level in these regions has been long sought after, yet prior designs have been unsatisfactory.

Pyramidal-horn reflector systems are of long standing use in the major microwave radio-relay networks. Although this type of antenna has lower signal-levels in the far-out sidelobe and backlobe regions than most other antenna types, it is characterized by unnecessarily high such levels. Furthermore, prior antenna types of this nature are also characterized by relatively high "spillover"--radiation lobes caused by direct radiation from the feed-horn of energy which misses the reflector.

Prior attempts to minimize "spillover" have resulted in conical-horn reflector systems in which a cylindrical shield is fitted around the feed-horn aperture (described for example in "The Electrical Characteristics of the Conical Horn Reflector Antenna"; J. M. Hines, Tingye Li, and R. H. Turrin, Bell System Technical Journal, Vol. XLII, July 1963, No. 4, part 1, pp. 1187–1211). Unfortunately however, this antenna type suffers from relatively high signal-levels in far-out sidelobe regions. Furthermore, this type of antenna heretofore has not employed corrugations in the interior feed-horn surface.

A third type of antenna which reduces radiation in the farout sidelobe region is the paraboloidal antenna, axially fed, which is surrounded by a cylindrical "tunnel" lined with absorbent material. This type of antenna, although satisfactory for many applications also suffers disadvantages. For example, an elevated signal-level in the sidelobe region (resulting from aperture blocking by the feed and support structure) is very undesired. Antenna systems of this nature, employing absorber materials as described, in general cannot be operated at relatively high power levels (because the absorber materials tend to become destroyed). Also, long tunnels must be fitted to the antenna in order to reduce sidelobe signal-levels at angles close to the main beam. As the length of the tunnel increases, substantial loss of gain in the signal-level of the main beam generally follows.

Corrugations have been utilized in feed-horns, but their use has generally been limited to axial feed-horns for parabolic reflectors (e.g., c.f. The scalar-feed--a high-performance feed for large paraboloid reflectors 1966, IEE Conference pub. No. 21, by A. J. Simmons and A. F. Kay). Furthermore, prior applications of corrugated feed-horns have generally been restricted to use in combination with large (in terms of wavelength) paraboloidal reflectors (c.f. Simmons and Kay, Supra), because of the high amount of aperture blocking associated with the axial feed arrangement (since aperture blocking undesirably reduces gain and causes undesirably high signal-levels in the antenna sidelobe regions).

SUMMARY OF THE INVENTION

The present invention utilizes corrugations on the interior of a high frequency feed-horn which is used as a non-axial feed for a cooperating parabolic reflective element in order to realize extraordinarily low signal-levels in far-out sidelobe and backlobe regions of the antenna pattern.

It is therefore an object of the present invention to realize relatively low signal-levels in the far-out sidelobe and backlobe antenna pattern regions of high frequency antennas.

Other objects, advantages and novel features of the invention will become apparent from the following detailed description of the invention when considered in conjunction with the accompanying drawings wherein:

DETAILED DESCRIPTION

An embodiment of the present invention has been designed and built to operate in the region of 37 GHz. Clearly this is only one particular frequency region, and other embodiments may readily be designed and constructed to operate at other frequencies within the microwave and millimeter wavelength region by utilizing the principles of the present invention as herein described and claimed.

Figure 1:
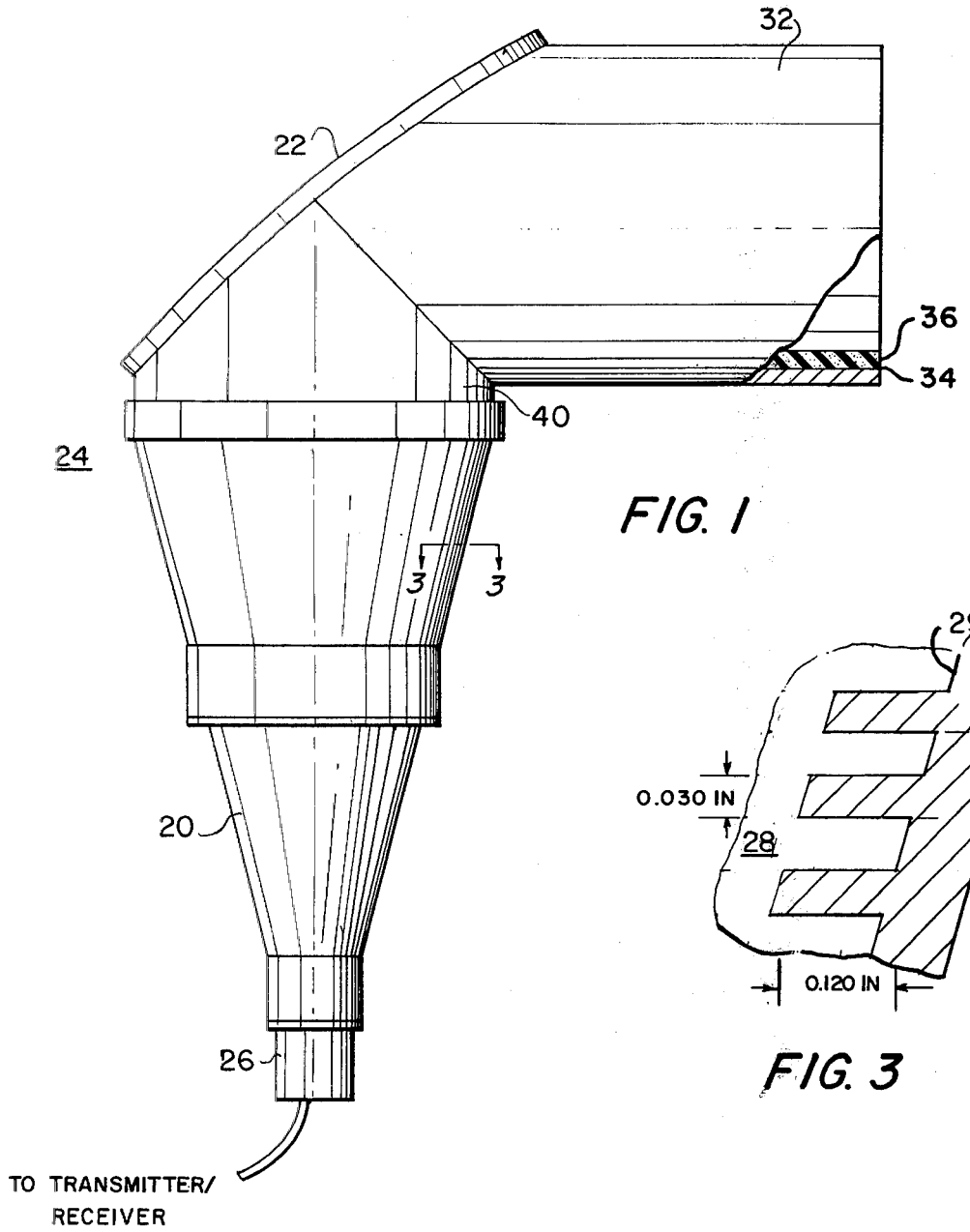
FIG. 1 is a pictorial diagram of an embodiment of the present invention.
Figure 2:
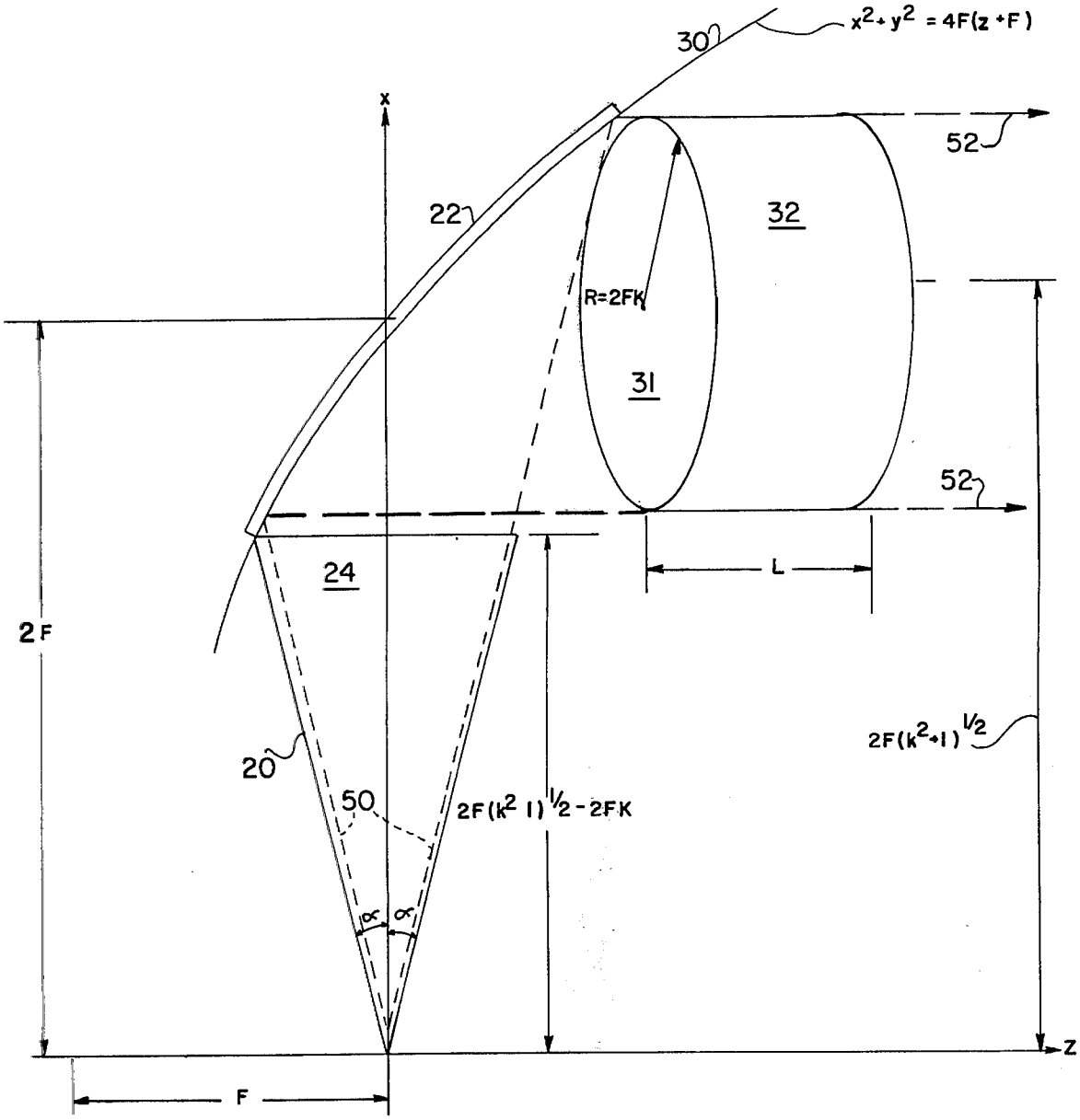
FIG. 2 is a diagram indicating the spatial interrelationship between elements depicted in FIG. 1.

FIG. 1 shows, in pictorial fashion, the general arrangement of elements of an embodiment of the present invention, while FIG. 2 shows more clearly the spatial interrelationship between those elements. A corrugated feed-horn 20 is arranged cooperatively with a parabolic shaped reflector 22. The corrugated feed-horn 20 is in the shape of a cone arranged with its apex a the origin of an $x$, $y$, $z$ orthogonal coordinate system, and whose axis coincides with the $x$ axis. A feed-element 26 is attached to the apex end of conical feed-horn 20, and is connected to a transmit-receive means not shown. The cone has an apex angle $2\alpha$, a length of $2F(K^2-1)^{1/2}-(2FK)$, and an outer aperture 24 at its open end (where F is the parabolic focal length, later described, and $K=\tan\alpha$). Angle $\alpha$ was chosen to be 15° for the embodiment of the present invention.

Circumferential grooves, or corrugations 28 (depicted in FIG. 3) are formed (as by machining, moulding, etc.) along the interior surface 29 of conical feed-horn 20. These corrugations have been used previously in feed-horns of microwave antennas, and are well described in the literature (c.f. Simmons and Kay, Supra, c.f. also "Modifications of Horn Antennas for Low Sidelobe Levels" IEEE Transactions on Antennas and Propagation, Vol. AP-14, pp. 605–610, Sept. 1966, by Lawrie and L. Peters, Jr. and in patents such as U.S. Pat. No. 3,631,502).

Figure 3:
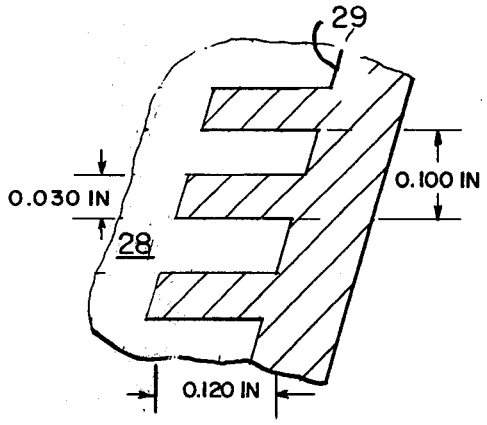
FIG. 3 depicts details of corrugations employed in the feedhorn of the embodiment of FIG. 1.

For a design frequency of about 37 GHz, the corrugations 28 utilized in the embodiment of the present invention have a height of about 0.120 inches, a thickness of approximately 0.030 inches, and are spaced apart by approximately 0.100 inches (depicted in FIG. 3).

The paraboloidal reflector 22 is formed by a section of a parabolic surface 30 (illustrated in FIG. 2) and is located in front of the feed-horn outer aperture 24. The parabolic surface 30 is defined by the equation $x^2 + y^2 = 4F(z + F)$, with focal length $F$. In the embodiment of the present invention, $F$ is chosen equal to 12.92 inches. The section (of surface 30) defining reflector 22 is described by the intersection of outer aperture 24 projected to intersect with parabolic surface 30. The size of reflector 22 is preferably made comparable to that of the wave-length of energy utilized. The feed-horn axis (i.e., x axis) intersects with the parabolic surface 30 at a distance $x = 2F$. An exit aperture 31 is centered at a distance $x = 2F(K^2 + 1)^{1/2}$, and has a radius $R = 2FK$.

An optional conducting cylindrical element, or tunnel 32, is placed parallel to the $z$ axis and fitted about the exit aperture 31 of reflector 22. Tunnel 32 has an interior radius $R = 2FK$ (where $K = \tan \alpha$) and a length L (for the embodiment of the present invention, L was chosen equal to 10 inches). The tunnel 32 may be lined along its interior conducting surface 34 with electromagnetically absorbent material 36.

A conducting shroud 40 is disposed and attached so as to enclose the region between the feed-horn aperture 24, the tunnel 32 (opening to reflector 22), and the reflector 22.

An alternative configuration, although having structual disadvantages, could utilize a pyramidal corrugated feed-horn as the feed in place of conical feed-horn 20. Of course the optional tunnel 32 associated with this pyramidal alternative would be rectangular in cross-section.

In designing an antenna in accordance with the principles of the present invention, the size of antenna exit aperture 31 (e.g. of radius $R = 2FK$) is generally first chosen (to meet the requirements of a particular application in terms of beamwidth and gain). The other parameters (i.e., $\alpha$ and F) are then chosen under the mathematical constraints to define the antenna geometry. Obviously, in the alternative, any parameter can be first selected to suit the constraints of a particular application, and the other parameter values then calculated.

In operation, the feed element 26 is energized with high frequency electromagnetic energy by the transmitter means (not shown), or receives high frequency energy which is then coupled to a receiver means (also not shown). Conical-feed-horn 20 then radiates (or receives) the energy (in spherical waveform fashion) and acts as an offset-feed for the parabolic reflector 22. Parabolic reflector 22 in turn acts to correct the spherical wave issuing from the feed-horn (generally in the $x$ direction as indicated by divergent dotted lines 50) into a plane wave traveling in the $z$ direction (indicated by dashed lines 52).

The corrugations 28 (depicted in FIG. 3) on feed-horn interior surface 27 act to equalize the E-plane and H-plane distributions within conical feed-horn and to cause low illumination (of parabolic reflector 22) outside of the conical region defined by angle $\alpha$ (referred to as low "edge" illumination). Maintaining low signal-level "edge" illumination for all signal polarizations is important in achieving the desired low signal-level in far-out sidelobe and backlobe antenna regions.

Tunnel 32 acts primarily to further reduce the "spill-over" from the feed to levels below the already low levels which result from the use of the corrugated feed-horn 20 in combination with the parabolic reflector 22.

If the optional absorber lining 36 of tunnel 32 is eliminated, a diffuse re-radiation of the "spillover" energy will result, causing moderate deterioration in sidelobe signal-levels.

The off-axis feed of the present invention precludes aperture blocking. Elimination of aperture blocking in combination with low edge illumination for both the E and H fields is critical to attainment of low signal-levels in the far-out sidelobe and backlobe regions of the antenna pattern.

The present invention is a high frequency antenna capable of realizing extraordinarily low signal-levels in the far-out sidelobe and backlobe regions. For the embodiment of the present invention, signal-levels in excess of 80 dB below the main beam signal-level have been attained over much of the antenna spatial region of interest. This antenna has a half-power beamwidth of approximately 1.6°, and sidelobe signal-levels well below 75 dB outside of a conical angle of 75°. Furthermore, it has been determined that utilizing corrugations in accordance with the present invention allows use of absorber materials at relatively high power levels without destruction.

Obviously many modifications and variations of the present invention are possible in light of the above teachings. It is therefore to be understood that within the scope of the appended claims the invention may be practiced otherwise than as specifically described.

What is claimed and desired to be secured by letters patent of the United States is:

1. A high frequency antenna system for radiating and receiving electromagnetic energy comprising:

a feed-horn having corrugations disposed on the interior conducting surface thereof;

parabolic reflective means disposed opposite the open end of said feed-horn for reflecting spherical wave-front energy radiated from said corrugated feed-horn and for converting the energy into plane-wave-front energy, and wherein said feed-horn is disposed so that none of the plane-wave-front energy is intercepted by said feed-horn;

whereby said corrugations cause low edge illumination of energy from said feed-horn incident on said parabolic reflective means;

and further wherein said feed-horn has a feed element located at the origin of an orthogonal $x$, $y$, $z$, axis reference system, the axis of the horn coinciding with the $x$ axis, said feed-horn having an angle $\alpha$ between the feed-horn interior surface and the $x$ axis and a length $2\ F\ (k^2-1)^{1/2} - (2FK)$; and said parabolic reflective means having a parabolic surface satisfying the equation $x^2 + y^2 = 4F(z + F)$ where $F$ is the focal length of said parabolic surface, and K is equal to $\tan\alpha$;

wherein spherical energy radiating from said feed-horn is converted to plane wavefront energy traveling in the direction of the x axis.

2. The antenna system of claim 1 wherein the region between said feed-horn and said reflective means is enclosed by a conductive shroud.

3. The antenna system of claim 1 wherein a tunnel is disposed about the exit aperture of said parabolic reflective means.

4. The antenna system of claim 3 wherein said interior surface comprises absorbing material.

5. The antenna system of claim 3 wherein said tunnel has a radius to its interior surface of $R = 2FK$.

* * * * *